United States Patent [19]

Harper

[11] Patent Number: 4,485,158

[45] Date of Patent: Nov. 27, 1984

[54] METHOD FOR PREPARING A MOSAIC LUMINESCENT SCREEN USING A MOSAIC PRECOATING

[75] Inventor: Stanley A. Harper, Providence Township, Lancaster County, Pa.

[73] Assignee: RCA Corporation, New York, N.Y.

[21] Appl. No.: 542,707

[22] Filed: Oct. 17, 1983

[51] Int. Cl.[3] ..... G03C 5/00; B05D 1/36; B05D 7/22

[52] U.S. Cl. ..... 430/28; 430/23; 430/29; 430/198; 427/64; 427/68; 427/71; 427/72

[58] Field of Search ..... 430/23, 29, 198, 28; 427/68, 64, 71, 72

[56] References Cited

U.S. PATENT DOCUMENTS

| | | | |
|---|---|---|---|
| 2,848,295 | 8/1958 | Skellett | 427/68 X |
| 2,992,107 | 7/1961 | Kaplan et al. | 430/23 |
| 3,140,176 | 7/1964 | Hoffman | 427/68 X |
| 3,367,790 | 2/1968 | Saulnier | 430/23 |
| 3,406,068 | 10/1968 | Law | 430/23 |
| 3,434,836 | 3/1969 | Kaplan | 430/23 |
| 3,585,074 | 6/1971 | Jones | 427/68 X |
| 3,966,474 | 6/1976 | Harper | 96/36.1 |
| 4,021,592 | 3/1977 | Fromson | 430/278 X |
| 4,089,687 | 5/1978 | Harper | 427/64 X |
| 4,284,694 | 8/1981 | Harper | 430/23 |
| 4,293,586 | 10/1981 | Unnai et al. | 427/68 |
| 4,318,971 | 3/1982 | Nishizawa et al. | 427/68 X |

FOREIGN PATENT DOCUMENTS

| | | | |
|---|---|---|---|
| 602838 | 8/1960 | Canada . | |
| 627962 | 9/1961 | Canada . | |
| 197810 | 10/1978 | Netherlands | 430/24 |

*Primary Examiner*—Mary F. Downey
*Assistant Examiner*—Mukund J. Shah
*Attorney, Agent, or Firm*—E. M. Whitacre; D. H. Irlbeck; L. Greenspan

[57] ABSTRACT

In a method for preparing a mosaic luminescent screen, islands of dry precoating material are adhered to a glass support surface at the sites of the mosaic parts of the screen. Then, the mosaic parts of the screen are deposited on the islands by the slurry-direct photographic method, including development with a turbulent aqueous developing medium. The use of islands provides the necessary adherence during development of the mosaic parts with a substantial reduction in the amount of precoating that must later be removed.

19 Claims, 14 Drawing Figures

METHOD FOR PREPARING A MOSAIC LUMINESCENT SCREEN USING A MOSAIC PRECOATING

BACKGROUND OF THE INVENTION

This invention relates to a novel method for producing a mosaic luminescent viewing screen for a CRT (cathode-ray tube), which CRT is particularly useful for color television and color data displays.

In preparing a mosaic luminescent viewing screen by the slurry-direct photographic process, as described, for example, in U.S. Pat. No. 3,406,068 to H. B. Law, a glass support, such as the inner surface of the faceplate panel of a CRT, is coated with an aqueous slurry comprising a photoinsolubilizable binder (photobinder), a photosensitizer therefor, and particles of phosphor material. The coating is dried and then exposed to a pattern of actinic light, as by exposure through an apertured mask, to produce regions of greater and regions of lesser solubility in the coating. The coating is then developed by removing only the coating regions of greater solubility by spraying and/or flushing the coating with water or aqueous solutions under pressure, thereby producing mosaic parts of the luminescent screen. Ordinarily, three different phosphor coatings are applied, so as to produce a cyclic array of mosaic parts of three different emission colors.

The adherence of the retained less-soluble regions of each phosphor coating to the glass surface is important, and that adherence is particularly critical during the development step. The loss of even a small part of the less-soluble regions, which should constitute mosaic parts of the mosaic screen, requires the screen to be scrapped.

Under ordinary circumstances, the adherence of a phosphor coating to a clean glass surface can be improved by applying to the glass surface a very thin precoating of a water-soluble polymeric material, such as polyvinyl alcohol, prior to applying the coating. A greater adherence of the phosphor coating to a clean glass surface can be achieved by employing a heavy precoating. In one form, the heavier precoating is composed of a photoinsolubilized dichromate-sensitized polyvinyl alcohol or other water-based photosensitive organic colloid with or without phosphor particles present. In another form, disclosed in my U.S. Pat. No. 3,966,474 issued June 29, 1976, the heavier precoating is a dried layer of an aqueous emulsion of water-insoluble polymeric material, such as polystyrene particles.

After the mosaic screen is produced, it is overcoated with a specular plastic film and then with a reflecting metal layer. When either form of heavier precoating is used, relatively large amounts of organic matter of the precoating must be gasified, and the gases formed must be removed through the phosphor mosaic and the metal layer during a subsequent baking step. Also, the precoating material, which incidentally or accidentally deposits on the inner sidewalls of the faceplate panel and on the mask-mounting studs, must be removed. Excessive amounts of the gases formed and/or too rapid removal of such gases can cause blistering of the reflecting layer, which is undesirable. Also, excessive gas formation can be chemically reducing, whereby elemental carbon forms along with the gases. The novel method permits the use of a thicker precoating but reduces the volume of precoating material that is used and must later be gasified.

SUMMARY OF THE INVENTION

In the novel method, islands of dry precoating material are adhered to a glass surface at the sites of the mosaic parts of the luminescent viewing screen. Thus, a minimal amount of precoating material remains on the glass surface to be gasified later. The fabrication of the luminescent screen is then carried out by known steps. The precoating material can be the same as the precoating material disclosed in my above-cited patent if a nonphotographic material for preparing the islands is used.

When a photographic method for preparing the islands is used, the islands may be formed by depositing a continuous layer containing my previously-disclosed precoating material and only a minor proportion of photoinsolubilizable binder, such as dichromated polyvinyl alcohol. Then, exposing the layer to a pattern of actinic light and developing the exposed pattern. In a preferred photographic method, a black matrix is first deposited on the glass surface. Then, islands of the precoating are selectively insolubilized by flood exposure through the glass surface and the openings in the matrix.

By producing islands of precoating material, the amount of material to be gasified can be minimized, and substantially no precoating material needs to be present outside the viewing area of the luminescent screen. Thus, in preparing a mosaic luminescent viewing screen on a glass surface, a greater adherence of the phosphor coating to the glass surface can be realized while problems normally associated with the use of a thick precoating can be avoided.

DETAILED DESCRIPTION OF THE EMBODIMENTS

At the outset of the novel method, islands of a dry precoating are adhered at the sites of mosaic parts of a mosaic luminescent screen. The mosaic parts and the islands may be in the form of round dots in a hexagonal array, or stripes in a parallel array, or any other shape and array that can be used for a luminescent viewing screen. The islands may be deposited and adhered by any graphic-arts procedure, photographic or nonphotographic. The following two embodiments employ photographic procedures.

Figure 1:
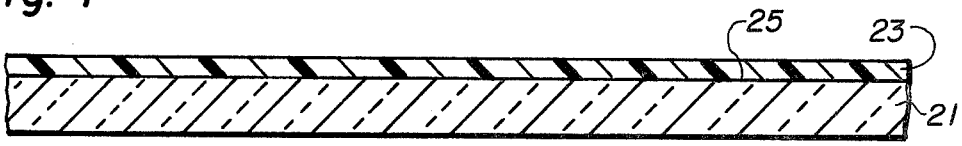
FIGS. 1 to 7 are a series of sectional elevational views through a fragment of a glass plate illustrating, in an idealized way, selected stages in a first embodiment of the novel method.
Figure 2:
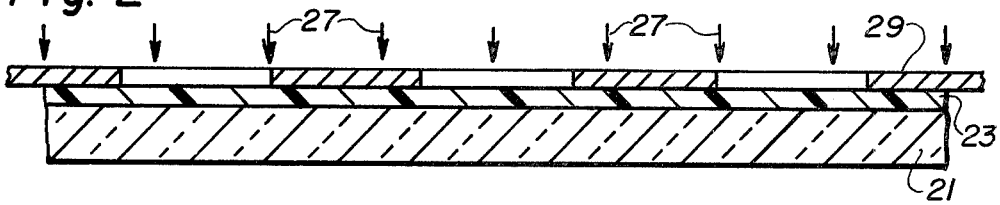
Figure 3:
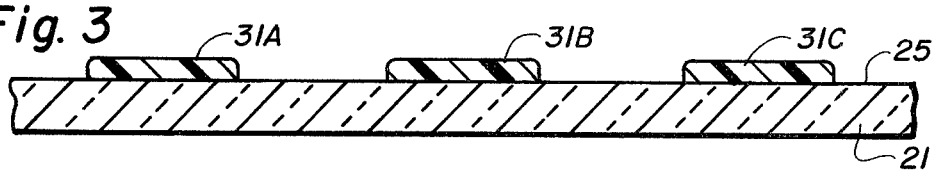

The first embodiment is designed to produce a nonmatrix luminescent viewing screen of parallel stripes of three different emission characteristics on a glass plate 21. In the first step, shown in FIG. 1, a continuous dry layer 23 of photoinsolubilizable precoating material is coated on one major surface 25 of the glass plate 21. As shown in FIG. 2, island stripes of the precoating layer 23 are insolubilized by exposure to actinic light, shown by the arrows 27, passing through a first photographic master 29 in contact with the layer 23. A 20- to 30-second exposure to ultraviolet light from a 100-watt mercury-vapor lamp should be adequate. The precoating is developed by removing the still-soluble precoating material leaving island stripes 31A, 31B and 31C of insolubilized precoating material at every site where a mosaic part of the screen is to be located, as shown in FIG. 3.

Figure 4:
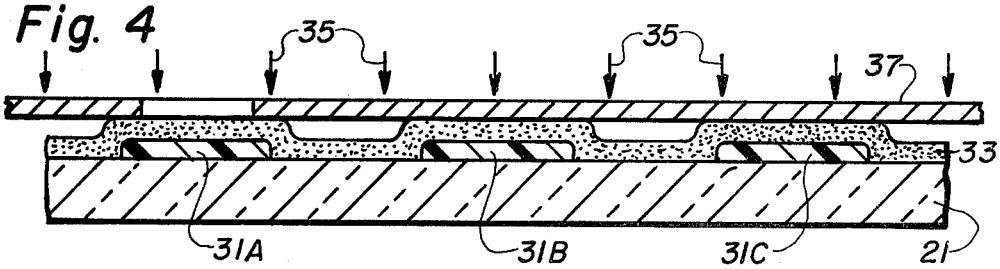
Figure 5:
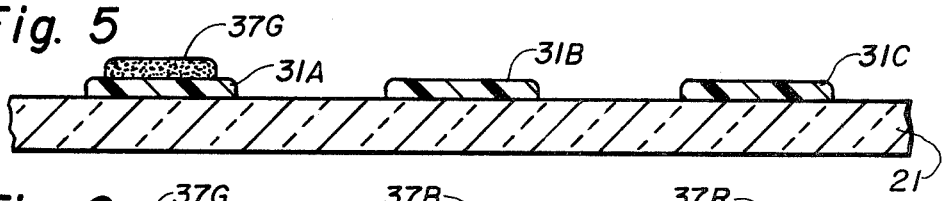

The islands 31A, 31B and 31C and the exposed glass surface 25 are coated with a first phosphor layer 33 comprising particulate phosphor having a first emission characteristic (such as green-emitting) and a photoinsolubilizable binder therefor. As shown in FIG. 4, the first phosphor layer 33 is exposed toactinic radiation 35 through a second photographic master 37, which permits mosaic stripes 37G to be insolubilized over the desired precoating island stripes 31A. The exposed phosphor layer 33 is developed with a turbulent aqueous medium, leaving only the insolubilized mosaic stripes 37G on the precoating islands 31A, as shown in FIG. 5. These last steps are repeated a second time substituting a particulate phosphor having a second emission characteristic (such as blue-emitting) producing mosaic stripes 37B over the desired precoating islands 31B. These last steps are repeated a third time substituting a particulate phosphor having a third emission characteristic (such as red-emitting) producing mosaic stripes 37R over the desired precoating islands 31C.

Figure 6:
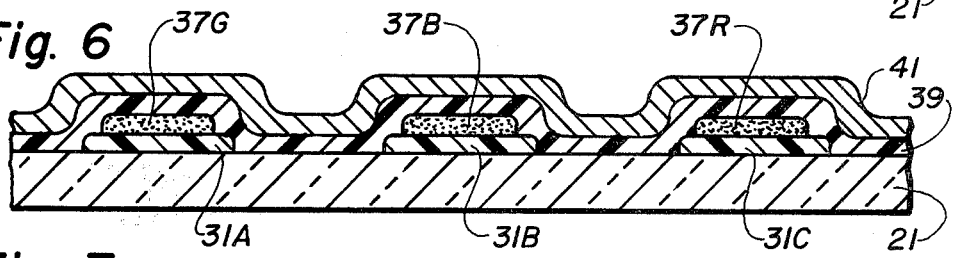
Figure 7:
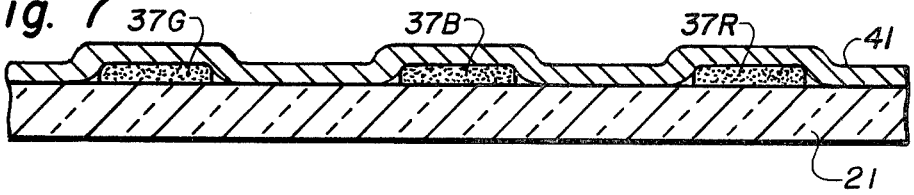

As shown in FIG. 6, the mosaic parts 37G, 37B and 37R and the exposed glass surface 25 are now coated, as by spray filming or emulsion filming, with a clean, dry, specular film 39 of organic polymeric material. An aluminum metal layer 41 is vapor deposited on the specular film 39. The glass plate 21 and the entire structure thereon are baked in air at about 350° C. whereby substantially all of the organic material therein is gasified and escapes through the metal layer 41, producing the screen structure shown in FIG. 7. The screen structure may now be assembled into a display device, such as a CRT, having means for selectively exciting each of the mosaic parts of the screen structure to luminescence.

Figure 8:
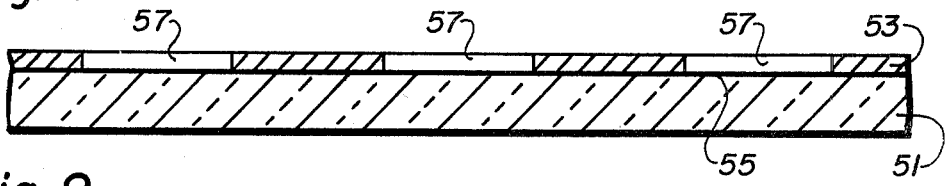
FIGS. 8 to 14 are a series of sectional elevational views through a fragment of a faceplate panel illustrating, in an idealized way, selected stages in a second embodiment of the novel method.

The second embodiment is designed to produce a matrix luminescent viewing screen of circular dots of three different emission characteristics in a hexagonal array on the inner surface of a glass faceplate 51 for a CRT. In the first step shown in FIG. 8, a black matrix 53 is produced on one major surface 55 of the glass plate 51 by any of the methods known in the art. The matrix 53 has openings 57 therethrough at the sites of the mosaic parts of the screen. Then, a continuous dry layer 59 of photoinsolubilizable precoating material is produced over the matrix 53 and the openings 57 therein.

Figure 9:
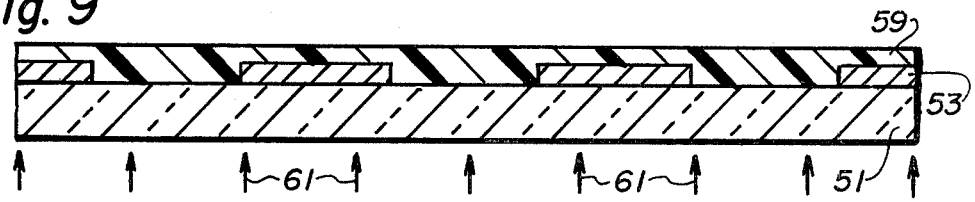
Figure 10:
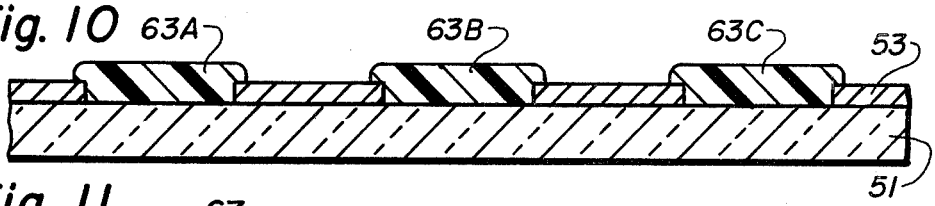
Figure 11:
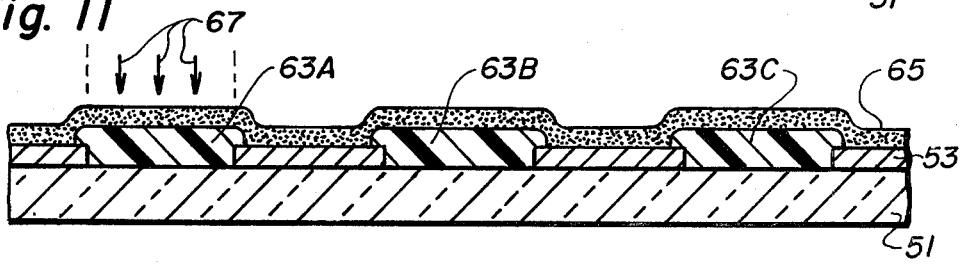

As shown in FIG. 9, island dots in the precoating layer 59 are insolubilized by exposure to actinic light, shown by the arrows 61, passing through the glass plate 51 and the openings 57 in the matrix 55 incident on the precoating layer 59. The precoating layer 59 is developed by removing only the still-soluble precoating material, leaving island dots 63A, 63B and 63C of insolubilized precoating material in every matrix opening, which is also the site where a mosaic part of the screen is to be located, as shown in FIG. 10.

Figure 12:
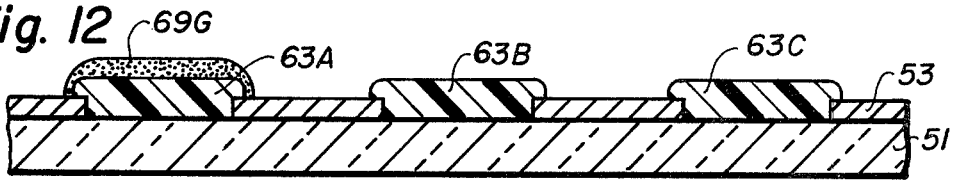

The islands 63A, 63B and 63C and the exposed glass surface 55 are coated with a first phosphor layer 65 as in the first embodiment. The first phosphor layer 65 is exposed to actinic radiation indicated by the arrows 67, by shadow projection through the shadow mask associated with the faceplate 51 in any manner known in the art, so as to insolubilize the desired mosaic dots over the desired precoating island dots 63A. The exposed phosphor layer 65 is developed with a turbulent aqueous medium, leaving only the insolubilized mosaic dots 69G on the precoating islands 63A as shown in FIG. 12. These last two steps are repeated a second time and a third time as in the first embodiment, except that the mosaic dots are insolubilized by shadow projection printing, producing mosaic dots 69B over the precoating islands 63B, and mosaic dots 69R over the precoating islands 63C.

Figure 13:
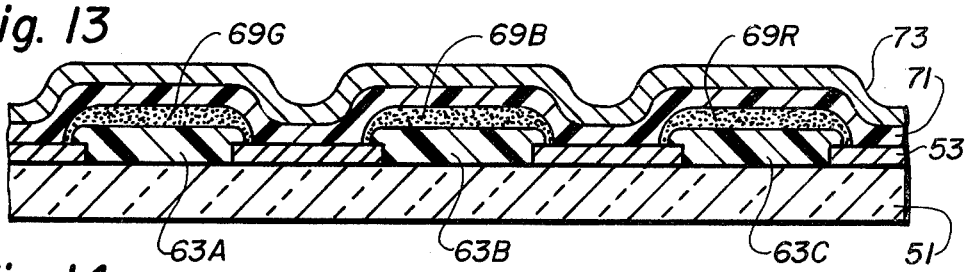
Figure 14:
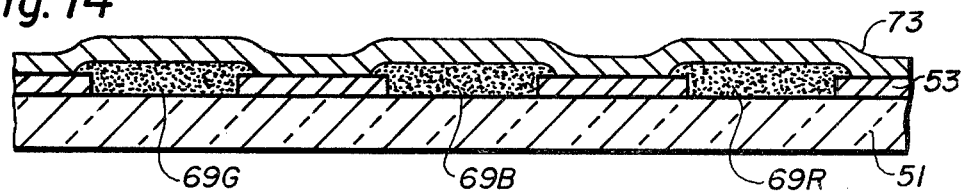

As shown in FIG. 13, the mosaic parts 69G, 69B and 69R and the exposed matrix therebetween are now coated with a clear dry specular film 71 of organic material. An aluminum metal layer 73 is vapor deposited on the specular film 71. The faceplate 51 and the entire structure thereon are baked in air at about 350° C. whereby substantially all of the organic material therein is gasified and escapes through the metal layer 73, producing the screen structure shown in FIG. 14.

A photoinsolubilizable precoating composition for use in both embodiments is formulated as follows with the indicated preferred weight percents of solids, and the practical ranges indicated in parentheses.

| | |
|---|---|
| Polystyrene copolymer latex of water-insoluble particles such as Opacifier E-305 (Morton-Norwich Products, Chicago, Ill.) | 8.00 (4 to 15) |
| Polyvinyl Alcohol such as Vinol 540 (Air Products & Chemicals, Calvert City, Ky.) | 1.00 (0.50 to 1.50) |
| Sodium Dichromate Sensitizer | 0.08 (0.04 to 0.12) |
| Surfactant such as Pluronic L-92 (Wyandotte Chemicals Co., Wyandotte, Mich.) | 0.02 (0.01 to 0.03) |
| Water | Balance |

The mixture is stirred slowly and continuously to maintain the suspension of the E-305 particles. For application to a matrix coated panel, the mixture is limp-stream dispensed, and the panel is spun rapidly to achieve a uniform coating. The coating is then dried with heat and clean flowing air to about 45° C. The drying temperature should be held below about 50° C.; otherwise, the coating would be partially insolubilized due to the heat. The upper range of polystyrene content is preferred since it imparts greater adherence. However, too great adherence may inhibit the cleanup of phosphor particles in later steps of the method. Other dichromate sensitizers and other ratios of dichromate-to-PVA (polyvinyl alcohol) may be used as is known in the art.

The ultraviolet light from a 100-watt mercury vapor lamp for 10 to 60 seconds should be adequate to expose the precoating layer. The exposed precoating layer is developed with a spray of water as disclosed in my above-cited patent. After developing, the coating is dried, and the phosphor coatings are applied. Any of the phosphor-slurry formulations useful for making luminescent viewing screens can be used here. Similarly, the exposure, development, filming and aluminizing methods and materials useful for making such screens can be used here. And, any methods for baking out organic matter from such screens can be used here.

The technology disclosed in my above-cited patent may be used in the practice of the novel method disclosed herein. This includes the development-time or segment-exposure test for adherence disclosed in column 6 of my prior patent.

It is found that the wet adherence is influenced by the glycol content in the slurries. For example, the weight of triethylene glycol in phosphor slurries should be held below 0.50 and preferably below 0.33, based on the PVA content, in order to achieve the desirable high adherence. Some data on adherence tests on 19V medium-resolution assemblies is summarized in the TABLE. The adherence is measured by the development time method, i.e., the spraying time required for the first phosphor stripe breaks or dot losses to occur. With precoating layers containing the E-305 latex, the adherence of the second (or third) phosphor layer is lower than that of the first. Consequently, the adherence of green-emitting layer as either the first phosphor layer applied or the second is shown in the TABLE. The average particle size of the milled green phosphor is about 6.0 $\mu$, and the screen weight is about 2.2 mg/cm$^2$. The weight of triethylene glycol in the slurry is about 0.25 the weight of the PVA.

TABLE

GREEN ADHERENCE IN SECONDS OF PHOSPHOR STRIPES ON HEAVY PRECOATING LINES

| RESIST WEIGHT (mg/cm$^2$) | GREEN AS FIRST COLOR (SEC.) | GREEN AS SECOND COLOR (SEC.) |
|---|---|---|
| 0.11 | 290 | — |
| 0.14 | 410 | 125 |
| 0.22 | 600 | 370 |
| 0.33 | 830 | 525 |

The data shows that the resist or precoating layer should be quite thick, e.g., 0.20 to 0.40 mg/cm$^2$ in order to achieve very high adherence values, although it may be in the range of 0.08 to 0.80 mg/cm$^2$ to be effective. Under similar conditions, the ordinary PVA precoating on the same 19V medium-resolution assemblies exhibits an average adherence of 66 seconds and a range of 44 to 118 seconds in the different tests. Obviously the measured adherence (66 sec.) is too close to typical developing times of perhaps 35 seconds. Thus, it is predicted that substantially every panel with an ordinary PVA precoating would be lost in production under the same conditions.

In addition to high levels of wet adherence, the heavy resist precoating islands provide very good cleanup characteristics to the slurries and result in low-porosity phosphor layers. The good porosity of the phosphor layers probably accounts for the improvement in light output that was noted in tests with 13V dot-mosaic display panels. When the novel method was used, six tubes averaged 159.9 foot lamberts per milliampere light output compared to standard tubes from the same period at only 154.4.

In the production of higher-resolution tricolor screens having smaller mosaic parts by the slurry direct photographic method, the wet adherence of the phosphor screen is found to be markedly lower compared with conventional screens having larger mosaic parts for use in entertainment television picture tubes. The higher-resolution screen is ordinarily in the form of phosphor dots in a hexagonal array. However, the screen may be in the form of narrow phosphor lines or stripes, similar to those in shadow-mask entertainment picture tubes. In a typical 19V medium-resolution shadow-mask tube, the mask slit width may be about 3.9 mils compared with about 8.3 mils width in a conventional 19V entertainment picture tube, and the width of a single phosphor stripe would be about 6 mils in the viewing screen of a medium-resolution tube as compared with about 11 mils in the screen of an entertainment tube. By using a sensitive methodof measuring wet-screen adherence during the water-spraying development step, it is found that the adherence of the medium-resolution screen is only about 28% of the wet adherence of the conventional-tube viewing screen. This explains why adherence scrap is often quite high during the production of higher-resolution screens. It 6 is not completely understood why the smaller phosphor elements of a medium-resolution viewing screen should show such a dramatic loss in adherence. Possibly, it may be simply the reduced phosphor-element size having much lower resistance to the force of the water spray. It is known, for example, that a continuous solid screen has very good adherence even when a typical small element of phosphor exhibits poor adherence. Because of the lower adherence of the mosaic part of a higher-resolution screen, it is desirable to use islands of thick layers of polystyrene-type particles to enhance the wet adherence.

A heavy precoating of organic material also may coat the radius, sidewalls, studs, and seal edge of the glass panel. Without adequate cleaning of the sidewall and seal edge, the organic material may cause a defective frit seal between the panel and the funnel. Dried precoating particles may be dislodged off the studs during mask insertion or removal. The use of the novel method permits removal of the precoating from these areas while the precoating is still soluble by flushing and/or wiping.

What is claimed is:

1. In a method for preparing a mosaic luminescent screen on a glass surface, the steps of A. adhering islands of a dry precoating to said glass surface at the sites of the mosaic parts of said luminescent screen, B. depositing over said islands a dry coating comprising phosphor particles and a photoinsolubilizable binder for said particles, C. photoinsolubilizing defined regions of said coating over said islands D. and then subjecting said photoinsolubilized regions to a turbulent aqueous developing medium.

2. The method defined in claim 1 wherein step A includes depositing on said glass surface a layer of an aqueous emulsion of discrete water-insoluble, organic polymeric particles and then drying said layer to produce said precoating, said dry precoating having a weight of about 0.08 to 0.80 mg/cm$^2$.

3. The method defined in claim 2 wherein said emulsion includes a photoinsolubilizable binder for said precoating, the dry weight proportion of said precoating binder being substantially less than the dry weight proportion of said polymeric particles.

4. The method defined in claim 3 wherein said islands are defined by exposing said dry precoating to a pattern of actinic light until said islands are insolubilized, and then developing said dry precoating, retaining said islands in place.

5. The method defined in claim 4 wherein said aqueous emulsion contains, on a dry-weight basis, a major proportion of particles of polystyrene copolymer, a minor proportion of polyvinyl alcohol and a dichromate photosensitizer for said polyvinyl alcohol.

6. The method defined in claim 4 wherein step A includes depositing on said glass surface a black matrix having openings therein, said openings defining the sites of the mosaic parts of said luminescent screen, producing said dry prcoating layer over said matrix, exposing said dry precoating layer to actinic light through said matrix, and then developing said precoating layer to produce said islands.

7. The method defined in claim 4 wherein step A includes producing dry precoating over said glass surface, projecting a pattern of actinic light incident on said dry precoating, and then developing said precoating layer to produce said islands.

8. The method defined in claim 1 wherein step D includes applying a pressure spray of aqueous developing liquid to said coating.

9. A method for preparing a mosaic luminescent screen on a glass surface comprising the steps of A. adhering to said glass surface a dry photoinsolubilizable layer of precoating material, B. exposing said layer of precoating material to a pattern of actinic radiation until islands of precoating material at the sites of the mosaic parts of said luminescent screen are insolubilized, C. developing said exposed layer to retain said islands and to remove the remainder of said layer, D. depositing over said islands of precoating material and glass surface a dry coating comprising phosphor particles and a water-soluble, photoinsolubilized binder for said phosphor particles, E. photoinsolubilizing defined regions of said coating over said islands F. and then developing said coating with a turbulent aqueous developing medium.

10. The method defined in claim 9 wherein a major proportion of said dry precoating layer is polystyrene copolymer and a minor proportion is dichromated polyvinyl alcohol.

11. The method defined in claim 10 wherein said dry coating layer is produced by depositing and drying an aqueous slurry of phosphor particles, dichromated polyvinyl alcohol and triethylene glycol, the weight of said triethylene glycol being less than 0.5 of the weight of said polyvinyl alcohol.

12. The method defined in claim 10 wherein the weight of said dry precoating layer is in the range of about 0.08 to 0.80 mg/cm$^2$.

13. The method defined in claim 10 wherein the weight of said dry precoating layer is in the range of about 0.20 to 0.40 mg/cm$^2$.

14. The method defined in claim 9 wherein said glass surface is the inner surface of the glass faceplate for a cathode-ray tube, said faceplate including a glass viewing window and an integral peripheral sidewall surrounding said window, and said layer of precoating material, at Step A, extends over the entire inner surface of said window and up adjacent inner surface portions of said sidewall.

15. The method defined in claim 14 including, prior to step A, producing on said glass surface, a black matrix having openings therein that define the sites of the mosaic parts of said luminescent screen; and at step B, exposing said precoating layer to actinic light projected through said matrix by flood exposure from a source spaced from the outer surface of said faceplate.

16. The method defined in claim 9, wherein steps D, E and F are conducted in sequence three times, each time with a phosphor having a different emission characteristic, and each time photoinsolubilizing said regions, in such manner as to produce a cyclic array of said three different phosphors.

17. The method defined in claim 9 including, after step F, overcoating said mosaic with a specular organic film, overcoating said film with a metal film and then baking said precoating, said coating, and said overcoatings thereon in such manner as to gasify organic material therein and to remove said gasified material.

18. A method for preparing a mosaic luminescent screen comprising a multiplicity of mosaic parts of at least two different luminescence characteristics on the inner surface of a glass faceplate panel, said panel including a glass viewing window, integral peripheral sidewalls surrounding said window and extending axially from the inner surface of said window, and a plurality of metal mounting studs implanted in said sidewalls and extending outwardly from the inner surface thereof, said method comprising the steps of A. producing on said inner surfaces of said window and said sidewalls a black matrix having openings therein that define the sites of said mosaic parts, B. adhering to said matrix and the exposed inner surface of said window a dry photoinsolubilizable layer of precoating material, C. flooding actinic light through said window and the openings in said matrix until islands of precoating material at said sites are insolubilized, D. developing said exposed precoating layer, retaining said islands of insolubilized material and removing substantially all of the soluble material from said matrix, said sidewalls and said studs, E. depositing on retained islands, mosaic parts comprising phosphor particles having one of said luminescent characteristics and a photoinsolubilized binder therefor, F. subjecting said mosaic parts to a turbulent aqueous developing medium, G. repeating steps E and F for mosaic parts of each other luminescent characteristic, H. depositing over said mosaic parts a specular film of organic polymeric material, I. depositing over said specular film an aluminum metal layer and J. baking said panel and layers thereon in air at temperatures and for times sufficient to gasify organic material in said layers and to permit the gases formed to escape through said metal layer.

19. The method defined in claim 18 wherein said precoating material consists essentially of dried particles of water-insoluble polystyrene and a minor proportion sufficient to render said precoating material photoinsolubilizable of dichromate-sensitized polyvinyl alcohol.

* * * * *